US012241180B2

(12) United States Patent
Tamura et al.

(10) Patent No.: US 12,241,180 B2
(45) Date of Patent: Mar. 4, 2025

(54) ACRYLONITRILE-BASED FIBER BUNDLE MANUFACTURING METHOD

(71) Applicant: Toray Industries, Inc., Tokyo (JP)

(72) Inventors: Tomoki Tamura, Otsu (JP); Joji Funakoshi, Otsu (JP); Takashi Kawamoto, Ehime (JP); Fumito Oshima, Ehime (JP); Koichi Aizu, Ehime (JP)

(73) Assignee: Toray Industries, Inc., Tokyo (JP)

( * ) Notice: Subject to any disclaimer, the term of this patent is extended or adjusted under 35 U.S.C. 154(b) by 809 days.

(21) Appl. No.: 17/442,237

(22) PCT Filed: Mar. 19, 2020

(86) PCT No.: PCT/JP2020/012328
§ 371 (c)(1),
(2) Date: Sep. 23, 2021

(87) PCT Pub. No.: WO2020/196277
PCT Pub. Date: Oct. 1, 2020

(65) Prior Publication Data

US 2022/0186405 A1 Jun. 16, 2022

(30) Foreign Application Priority Data

Mar. 28, 2019 (JP) ..... 2019-063203

(51) Int. Cl.
*D01F 9/22* (2006.01)
*D01D 5/06* (2006.01)
*D01F 6/18* (2006.01)

(52) U.S. Cl.
CPC ..... *D01F 9/225* (2013.01); *D01D 5/06* (2013.01); *D01F 6/18* (2013.01)

(58) Field of Classification Search
CPC ..... D01F 9/225; D01F 6/18; D01D 5/06
See application file for complete search history.

(56) References Cited

U.S. PATENT DOCUMENTS 7,887,728 B2 * 2/2011 Takatani ..... D01D 4/08 425/72.1

FOREIGN PATENT DOCUMENTS

| | | | | |
|---|---|---|---|---|
| JP | 0291206 | A | | 3/1990 |
| JP | 02112409 | A | | 4/1990 |
| JP | 2000355829 | A | | 12/2000 |
| JP | 2017172081 | A | * | 9/2017 |
| WO | 2006001324 | A1 | | 1/2006 |

OTHER PUBLICATIONS

International Search Report and Written Opinion for International Application No. PCT/JP2020/012328, dated Jun. 9, 2020, 5 pages.

* cited by examiner

*Primary Examiner* — Amina S Khan
(74) *Attorney, Agent, or Firm* — Buchanan Ingersoll & Rooney PC

(57) ABSTRACT

Provided herein is a method for producing an acrylonitrile based fiber bundle by dry-jet wet spinning technique that serves to allow a high-grade, high-quality acrylonitrile based fiber bundle to be produced stably even if the traveling speed of the coagulated fibers is increased or the number of spinneret discharge holes is maximized in an attempt to enhance the production efficiency. The production method for an acrylonitrile based fiber bundle is characterized by first extruding a spinning dope solution through a plurality of discharge holes in a spinneret, then allowing the spinning dope solution to run downward into a coagulation bath liquid stored in a coagulation bath to form coagulated fibers, turning the coagulated fibers upward on a direction changing guide part located in the coagulation bath liquid below the spinneret, and pulling them out of the coagulation bath liquid, wherein certain requirements are met.

9 Claims, 12 Drawing Sheets

[Fig. 1]
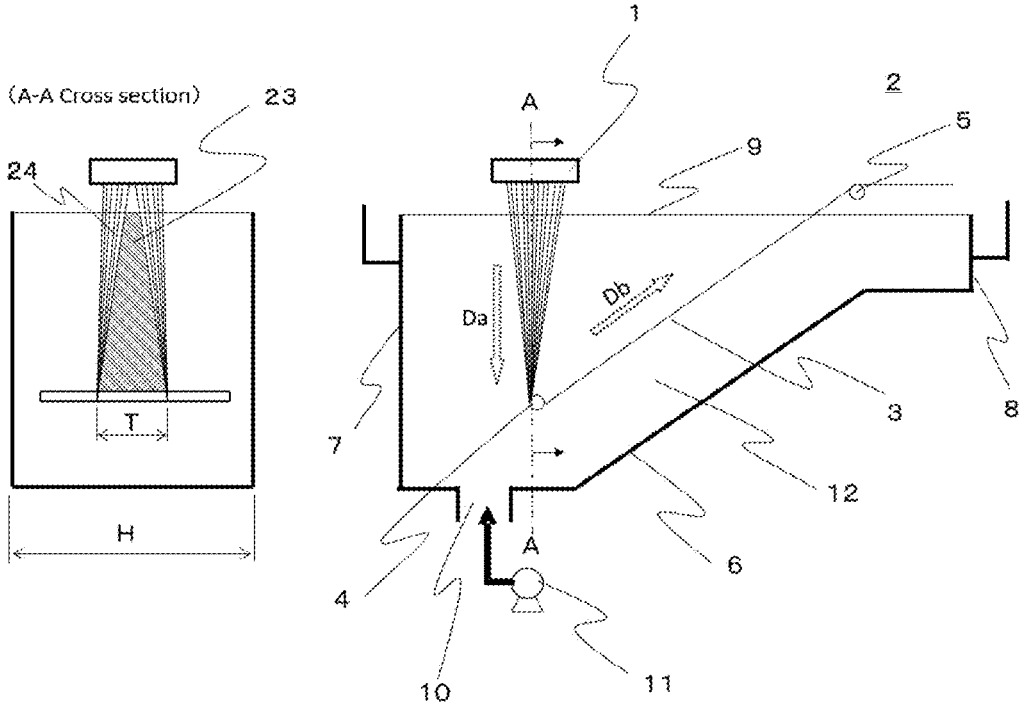
[Fig. 2]
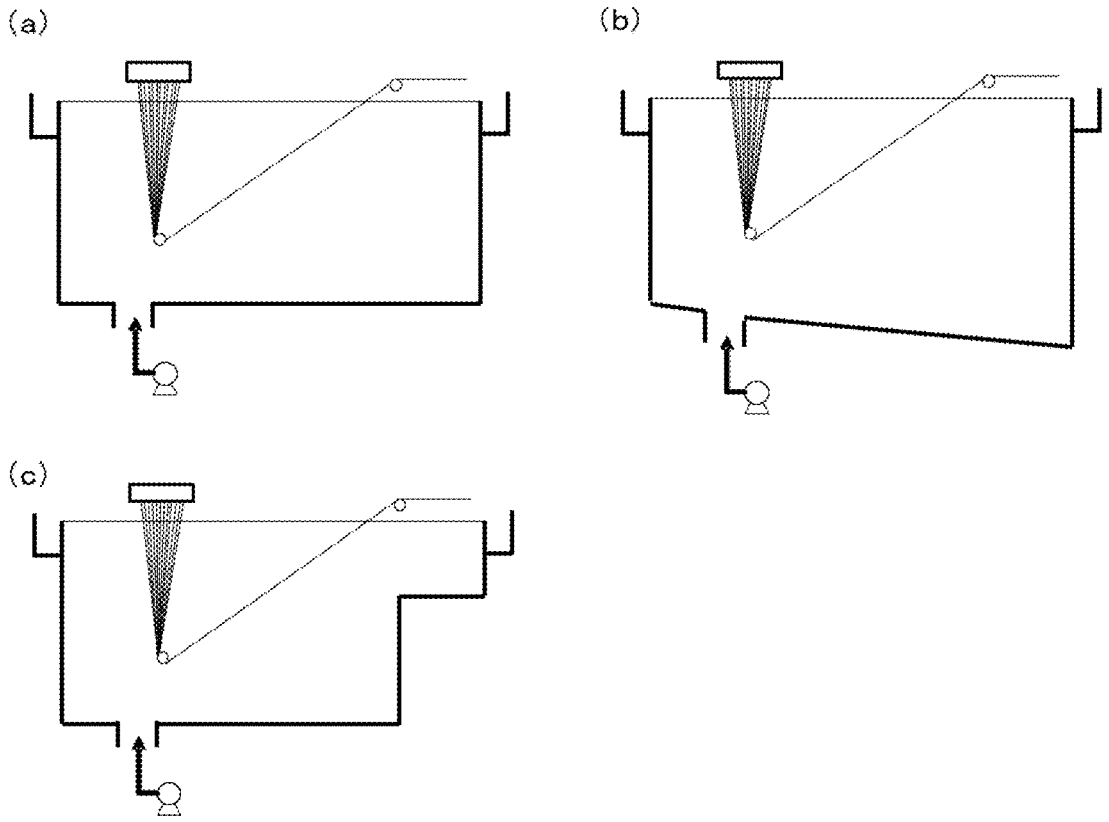

[Fig. 3]
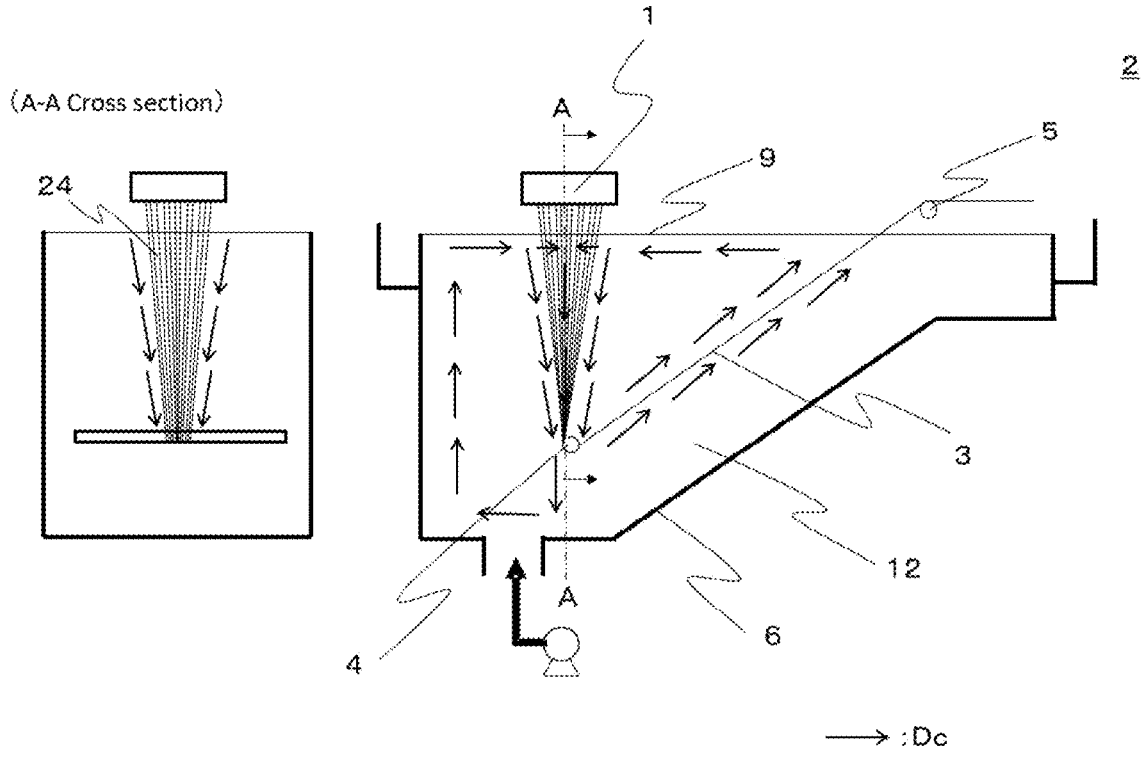
[Fig. 4]
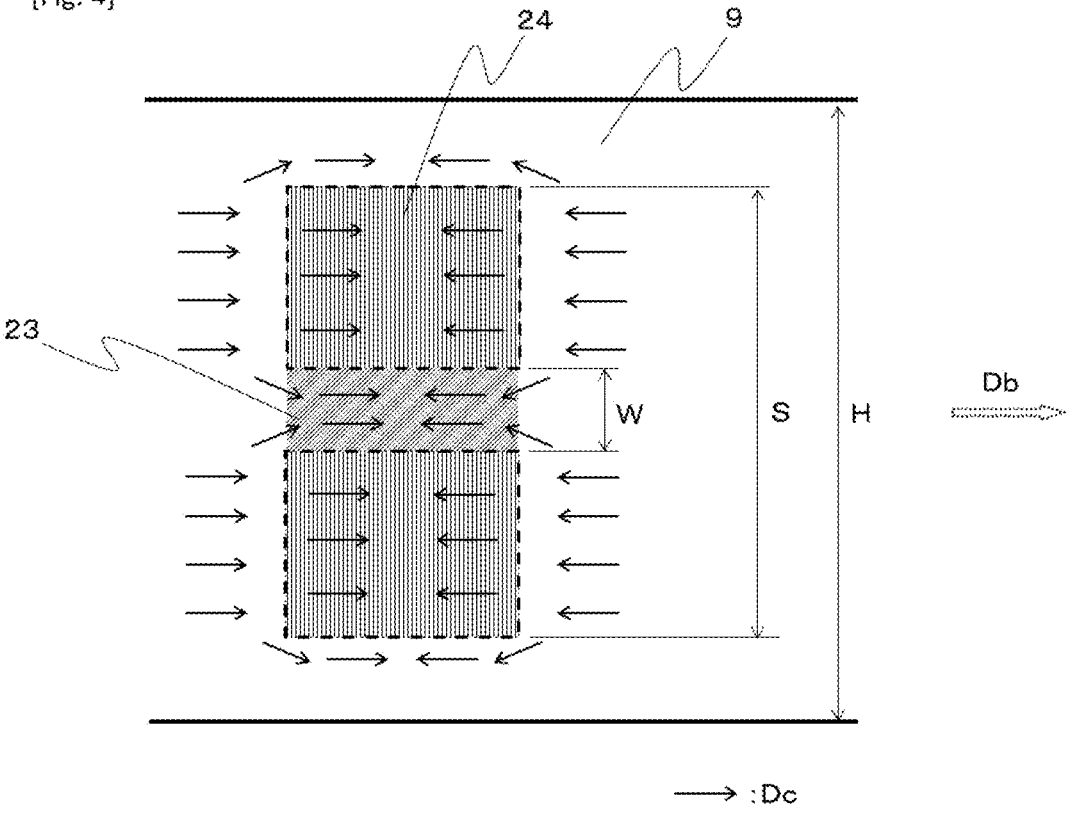

[Fig. 5]
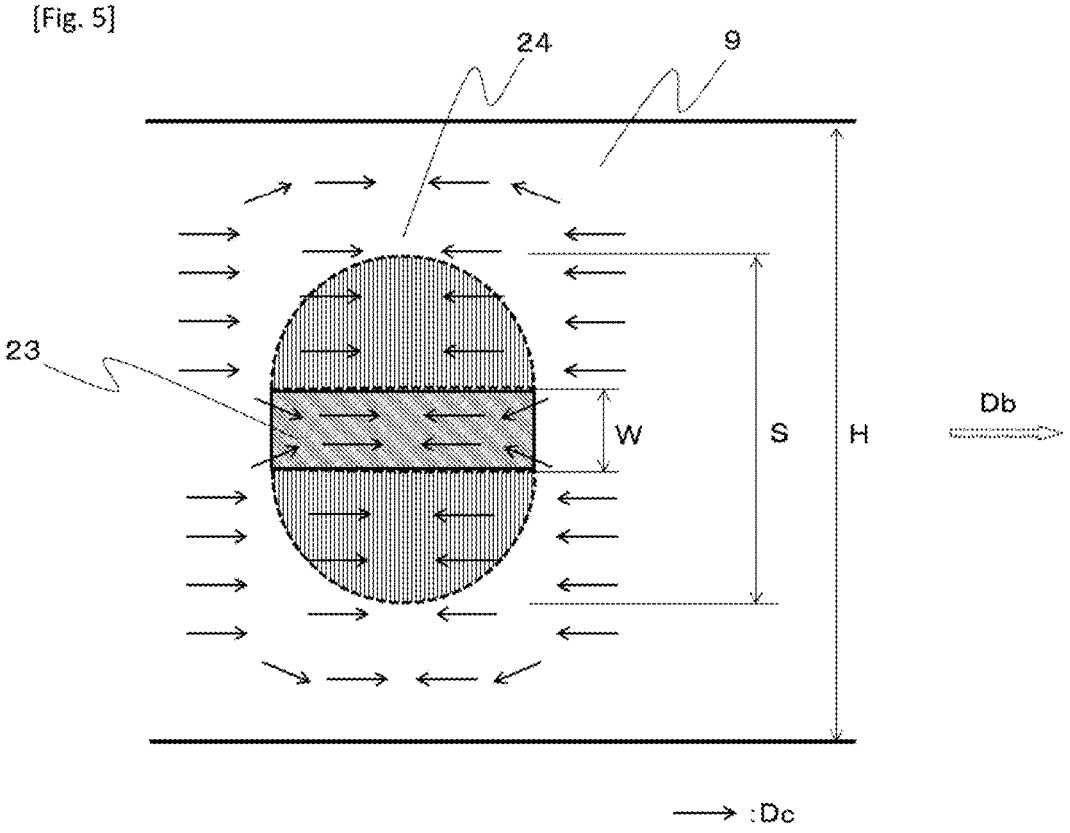

[Fig. 6]
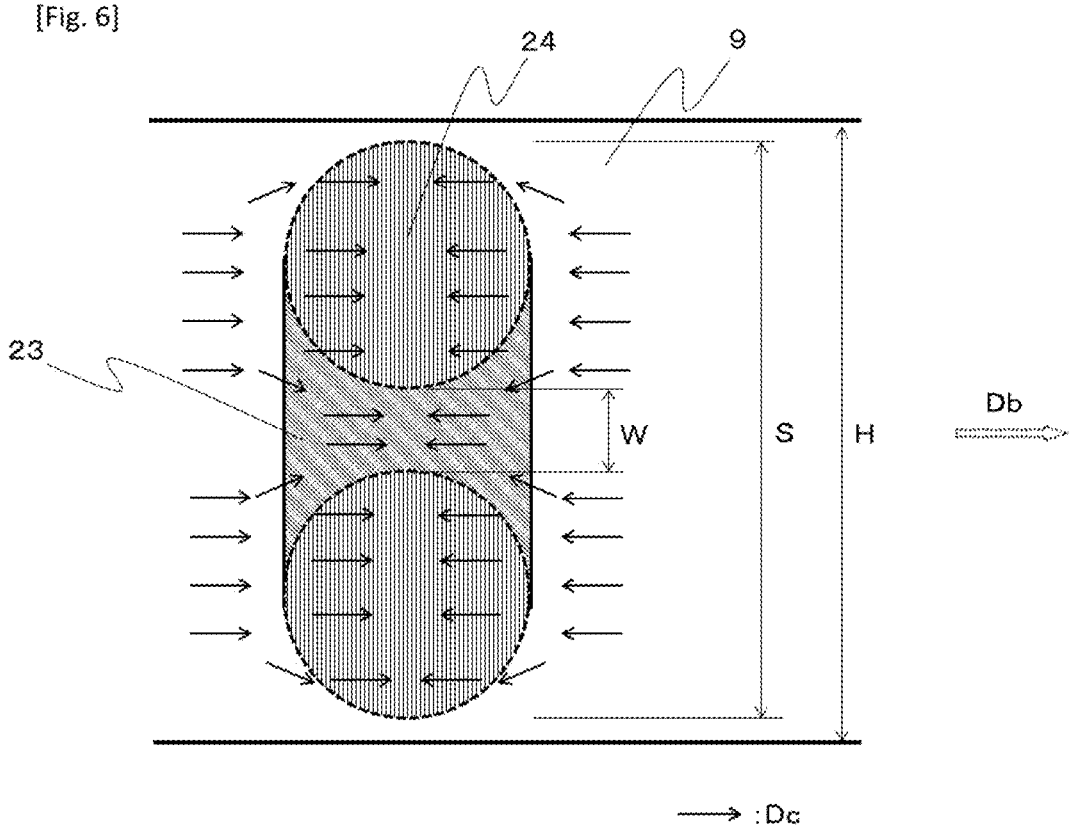
[Fig. 7]
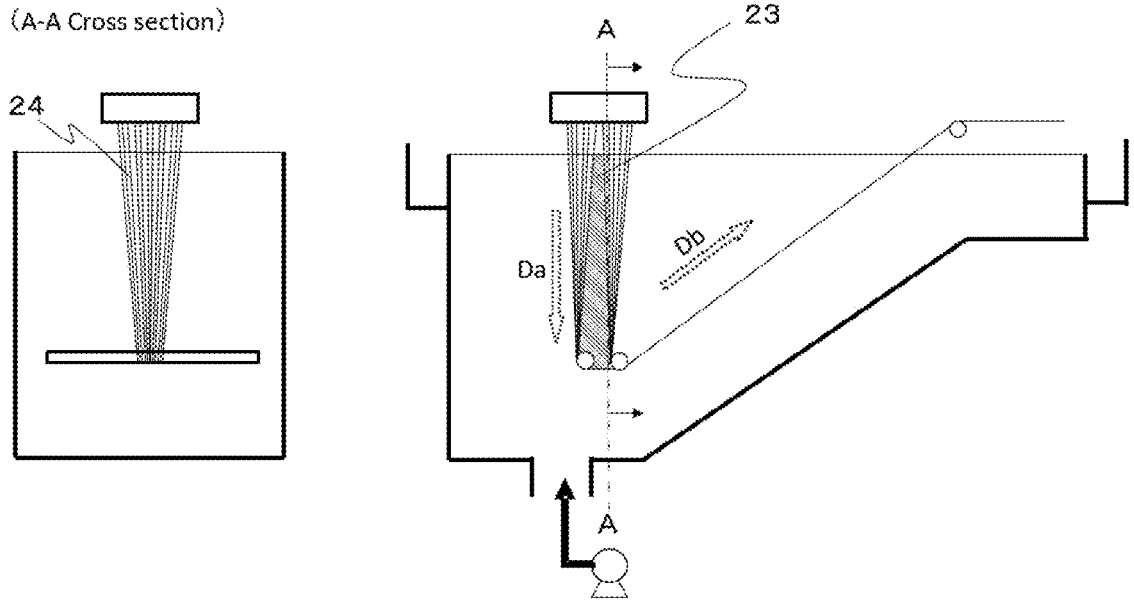

[Fig. 8]
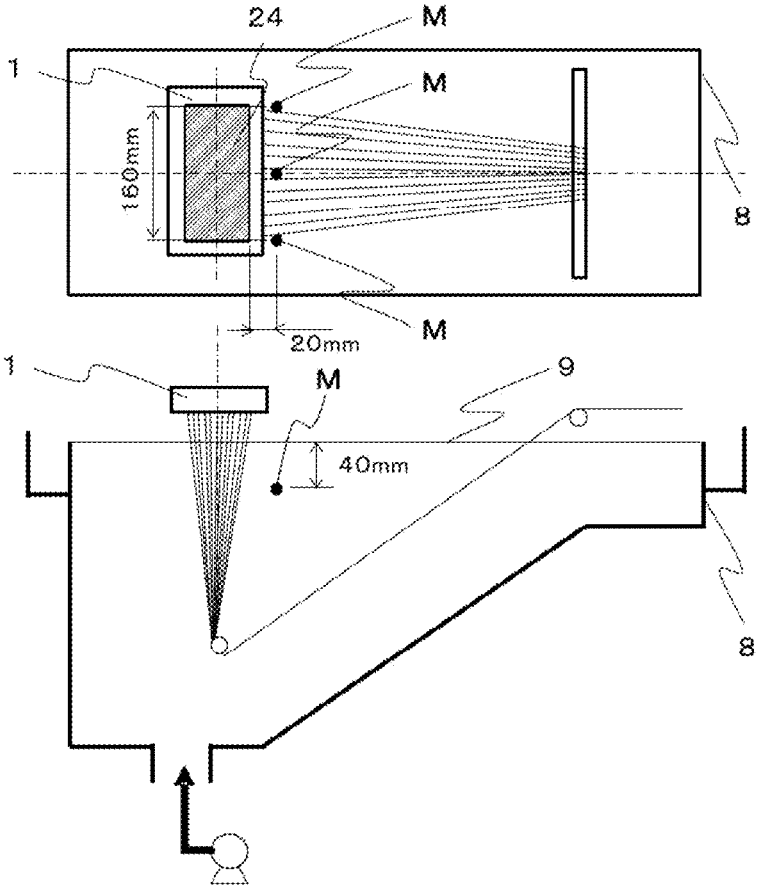

[Fig. 9]
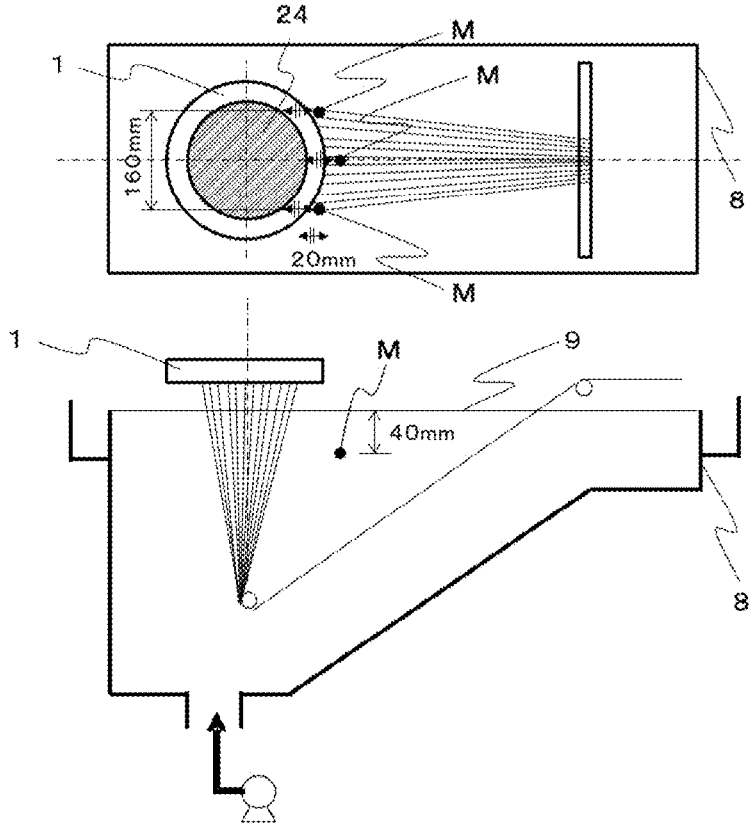

[Fig. 10]
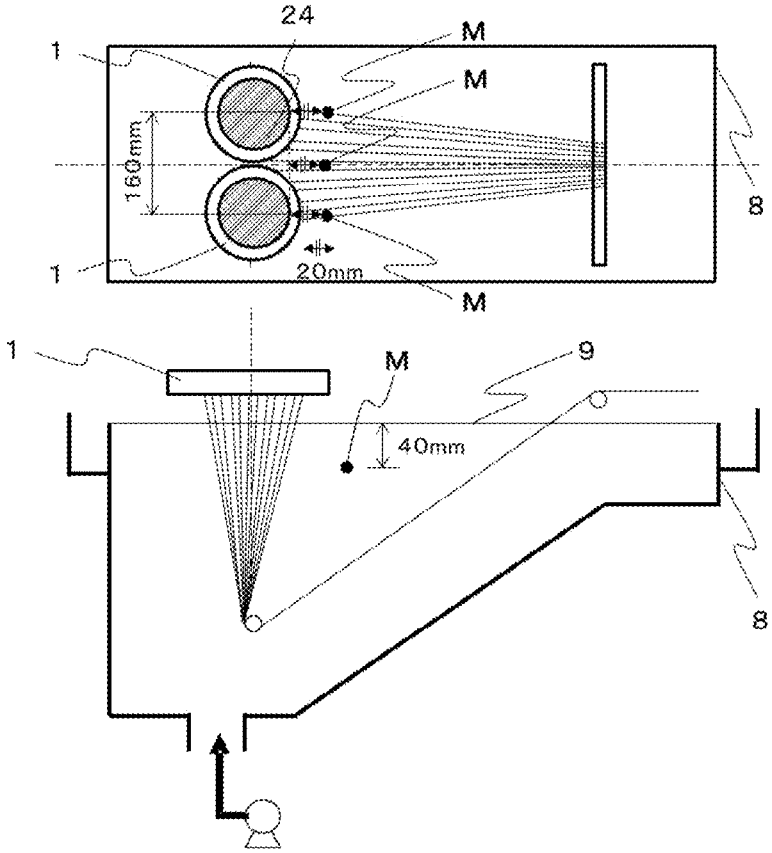
[Fig. 11]
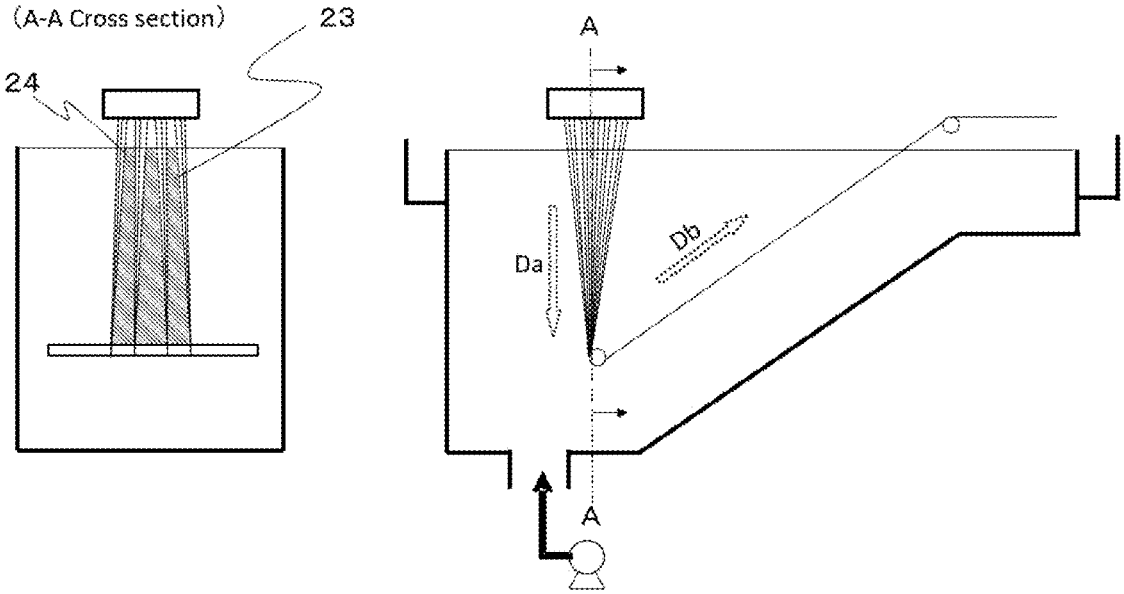

[Fig. 12]
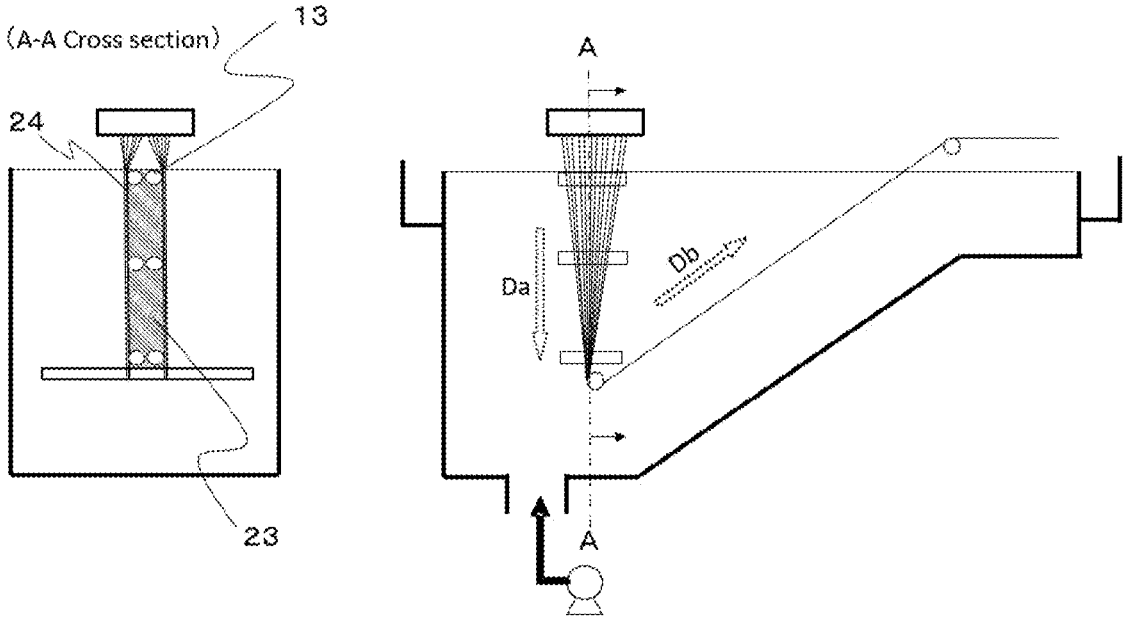
[Fig. 13]
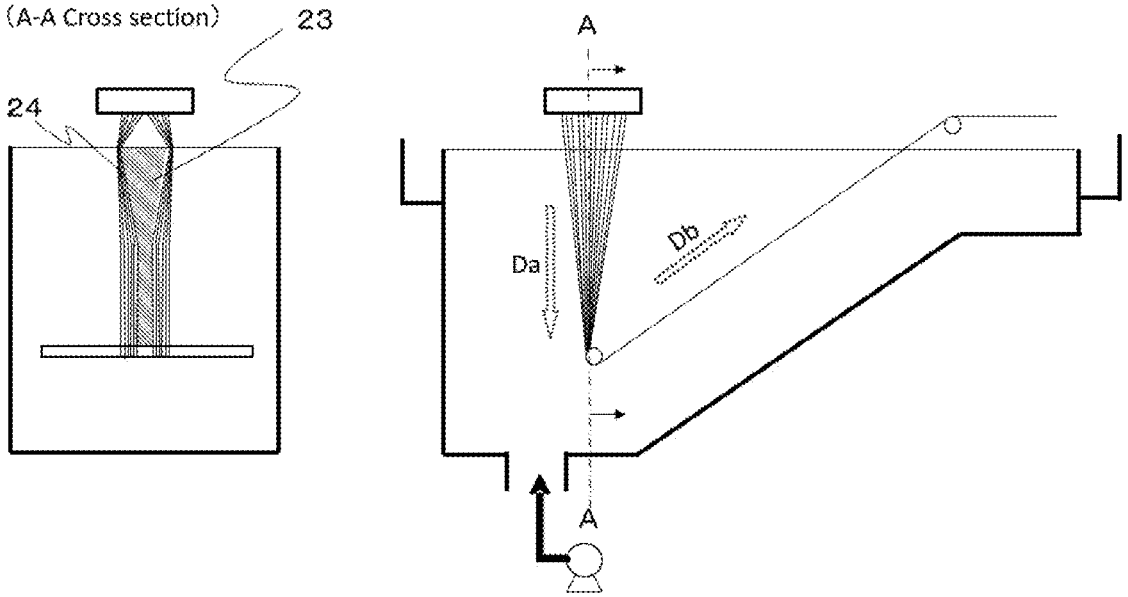

[Fig. 14]
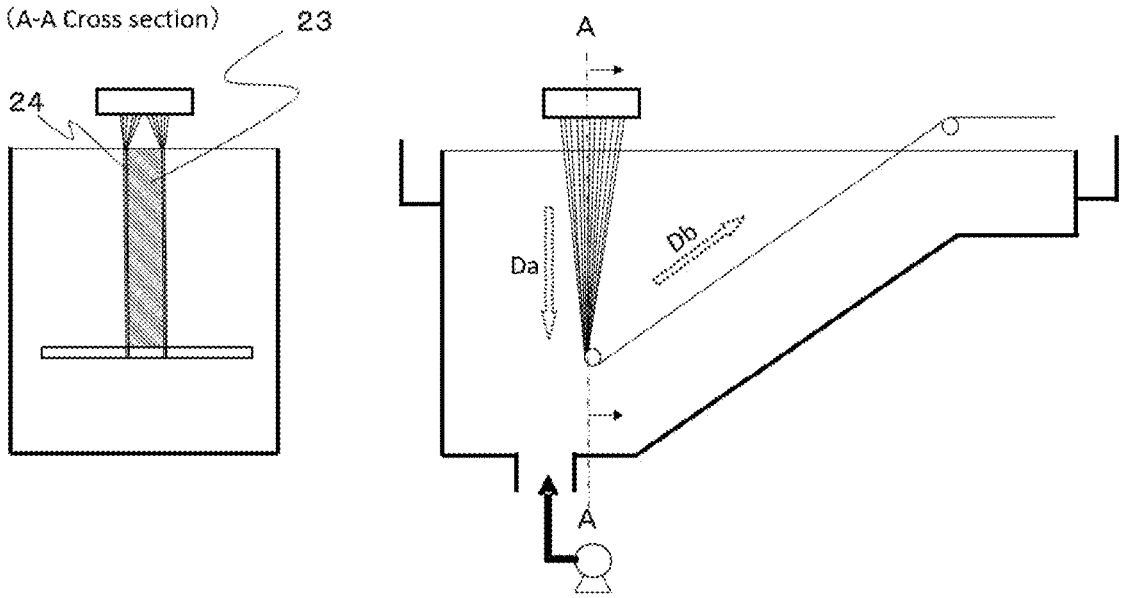
[Fig. 15]
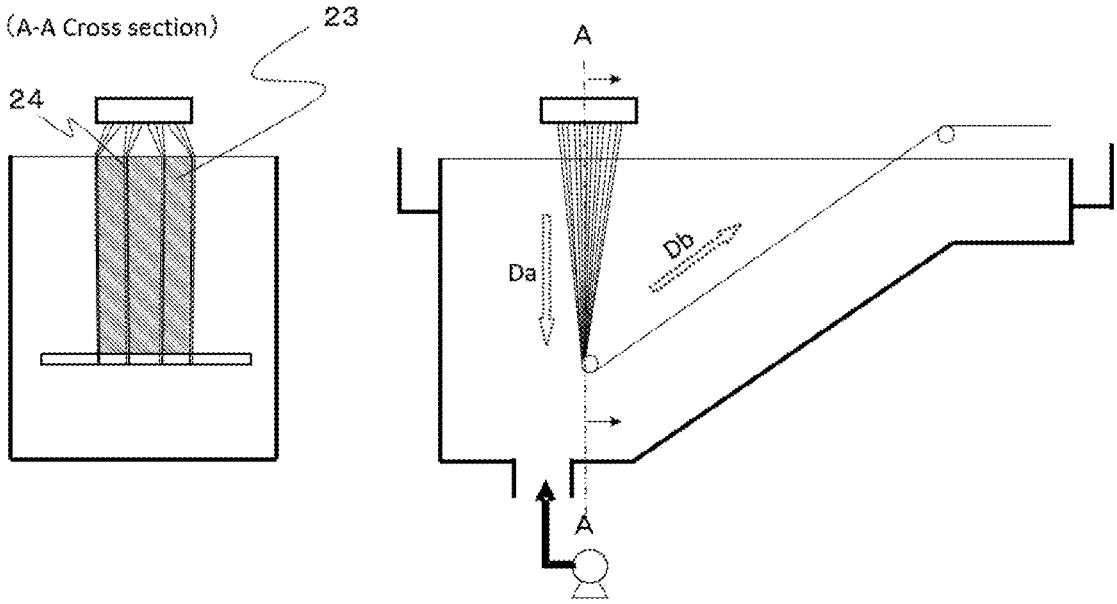

[Fig. 16]
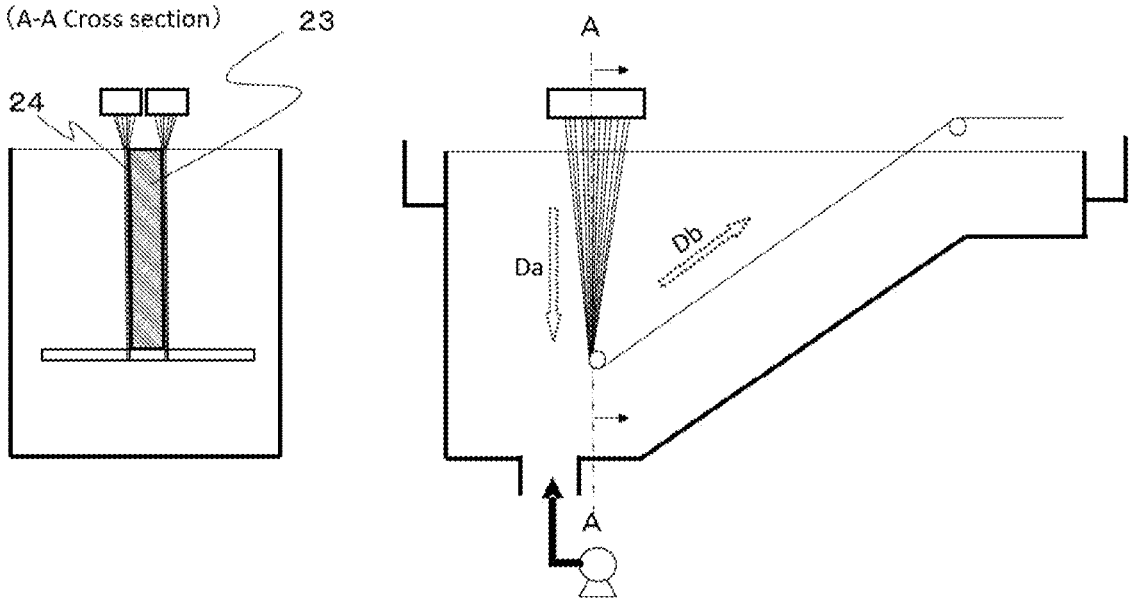
[Fig. 17]
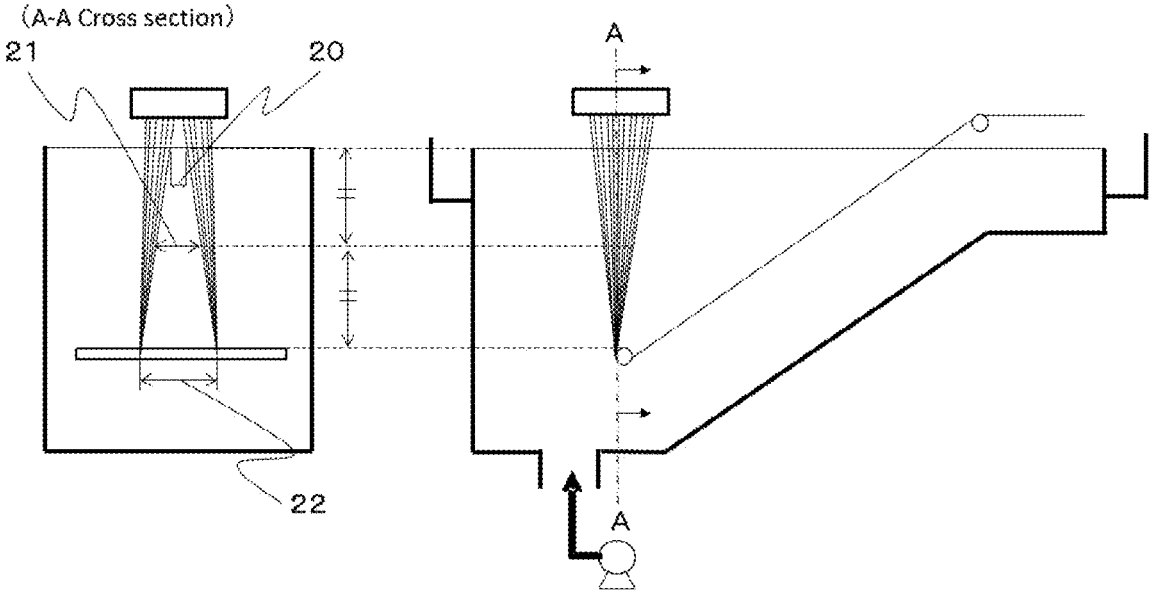

[Fig. 18]
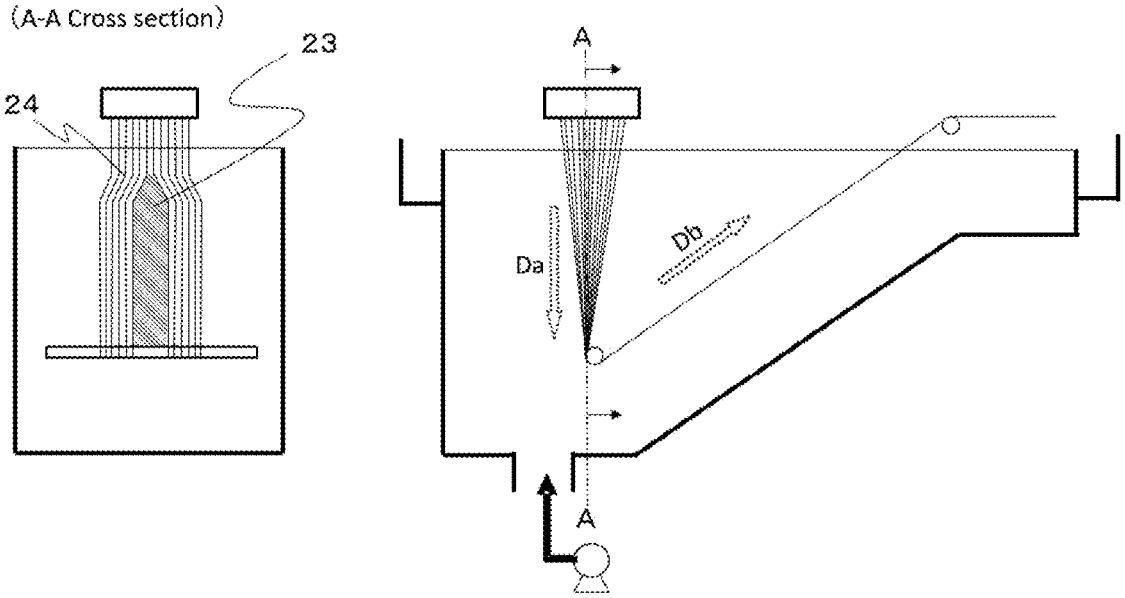
[Fig. 19]
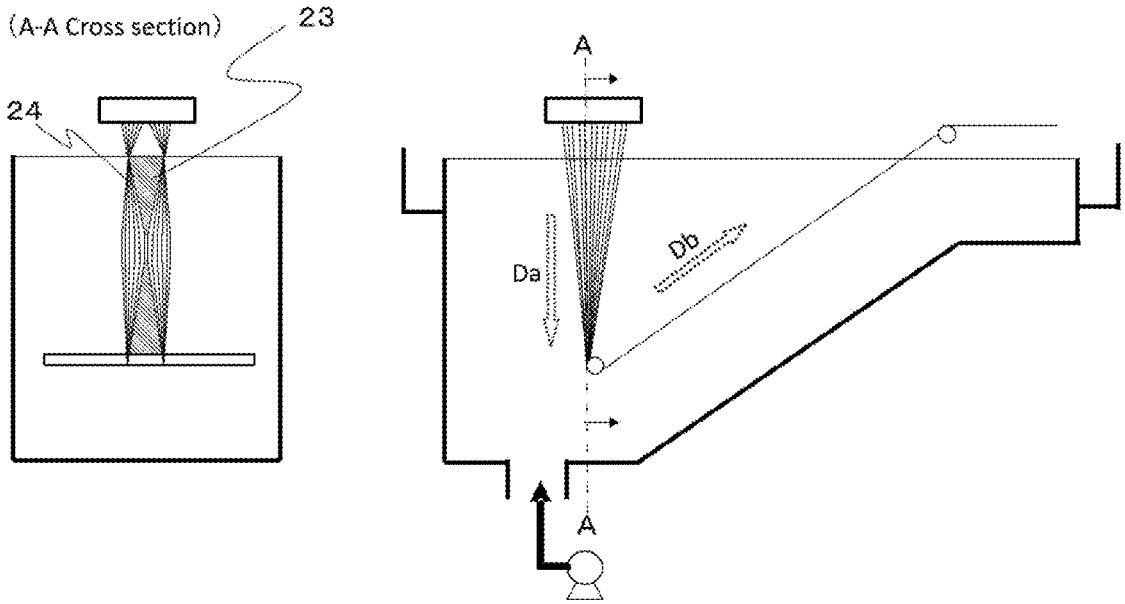

[Fig. 20]
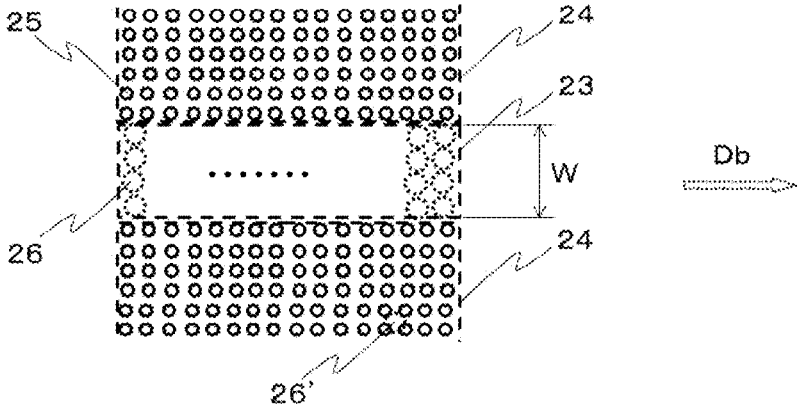

ACRYLONITRILE-BASED FIBER BUNDLE MANUFACTURING METHOD

CROSS REFERENCE TO RELATED APPLICATIONS

This is the U.S. National Phase application of PCT/JP2020/012328, filed Mar. 19, 2020, which claims priority to Japanese Patent Application No. 2019-063203, filed Mar. 28, 2019, the disclosures of each of these applications being incorporated herein by reference in their entireties for all purposes.

FIELD OF THE INVENTION

The present invention relates to a production method for a stable, high-quality, high-grade acrylonitrile based fiber bundle suitable for producing a carbon fiber bundle.

BACKGROUND OF THE INVENTION

For the production of an acrylonitrile based fiber bundle used as a precursor fiber bundle for a carbon fiber bundle, it is important to reduce the production cost by increasing the production efficiency. To meet this objective, various methods have been adopted such as increasing the number of spinneret holes per spindle, increasing the number of spindles or fibers, and increasing the traveling speed of the fibers. Of these, the method of increasing the number of spinneret holes per spindle (increasing the number of holes, adopting an arrangement with higher discharge hole density) and the method of increasing the traveling speed of the fibers (adopting a higher speed) are highly advantageous from the viewpoint of meeting the above objective without requiring large equipment investment.

In particular, the dry-jet wet spinning method, which adopts an air layer (air gap) provided between the spinneret and the surface of the coagulation bath liquid, is a good means for increasing the traveling speed of the fiber because the spinning dope solution discharged from the spinneret surface can thin as it runs through the air gap where air resistance is small. If this spinning method is used, furthermore, the distance across the air gap can be maintained constant, serving to produce an acrylonitrile based fiber bundle with stable quality and grade and ensures high productivity.

In general, in this dry-jet wet spinning method, the spinning dope solution is first extruded into the air from a spinneret and then the spinning dope solution comes into contact with a coagulation bath liquid to form coagulated fibers, which travel downward (toward the bottom of the coagulation bath) through the coagulation bath liquid. After traveling over a certain distance, their traveling direction is changed by a direction changing guide part to cause them to travel diagonally upward (toward the surface of the coagulation bath liquid), and they finally run out of the coagulation bath liquid into the air, followed by being conveyed into the next process. Since accompanying flows are generated as a result of the traveling of the coagulated fibers, the accompanying flows increase with increasing traveling speed, number of holes, and density of discharge holes. As accompanying flows increase, the flow velocity of the coagulation bath liquid around the coagulated fibers increases, which causes uneven tension and physical properties of the coagulated fibers, resulting in deterioration of the quality and grade of the acrylonitrile based fiber bundle. In addition, as the flow speed of the flowing coagulation bath liquid increases, the surface of the coagulation bath liquid fluctuates more largely, which causes a decrease in spinnability and then leads to a decrease in production efficiency. This suggests that control of the flow of the coagulation bath liquid is an extremely important factor in the improvement in quality, grate, and production efficiency of an acrylonitrile based fiber bundle.

Here, an available method for controlling the flow of the coagulation bath liquid around the coagulated fibers is described in Patent document 1. For the method described in Patent document 1, it is proposed that a block containing a plurality of spinneret discharge holes is formed, followed by dividing the block into two or more parts in such a manner that the distance between any two adjacent blocks is at least twice the distance between the spinneret and the surface of the coagulation bath liquid. Furthermore, it is also described that a protrusion should be formed on the direction changing guide part existing in the coagulation bath liquid to work to change the traveling course of the coagulated fibers, which ensures improved control of the flow of the coagulation bath liquid and an increased spinnability of the coagulated fibers.

In addition, according to the spinning method described in Patent document 2, a thin tube having two or more openings is used to separate the coagulated fibers and the coagulation bath liquid, and a plurality of direction changing guide parts are arranged on the downstream side thereof so that the coagulated fibers are divided into two or more parts in the take-up direction of the coagulated fibers. This works to control the turbulence and vortex generation in the coagulation bath liquid near the surface of the coagulation bath liquid and accordingly serves for the production of coagulated fibers having high quality and a certain required level of quality.

PATENT DOCUMENTS

Patent document 1: Japanese Unexamined Patent Publication (Kokai) No. HEI 2-91206

Patent document 2: Japanese Unexamined Patent Publication (Kokai) No. HEI 2-112409

SUMMARY OF THE INVENTION

However, these conventional spinning methods have problems as described below.

The spinning method proposed in Patent document 1 sometimes fails in sufficiently relaxing the accompanying flows around coagulated fibers in the coagulation bath liquid, resulting in an insufficient improvement in the spinnability of the coagulated fibers.

Furthermore, if fibers among the coagulated fibers are in a densely packed state as they travel, the accompanying flows can increase and in addition, the flow speed of the coagulation bath liquid moving toward the coagulated fibers can increase in the vicinity of the surface of the coagulated bath liquid, possibly leading to collisions between the fibers and generation of local vortices near the surface of the coagulation bath liquid (hereinafter referred to simply as local vortices). If such local vortices occur, it causes fluctuations in the air gap, i.e., the distance between the spinneret and the surface of the coagulation bath liquid. In addition, as the accompanying flows increase, the sway of the coagulated fibers grows between the spinneret and the direction changing guide part, and these troubles can cause larger fluctuations in the surface of the coagulation bath liquid and yarn breaks, possibly leading to a spinning failure in the worst case.

Furthermore, the spinning method proposed in Patent document 1 uses blocks containing a plurality of spinneret discharge holes and the distances between the blocks are increased. Accordingly, it requires spinnerets with larger widths. It also requires a coagulation bath with a larger width. As the use of equipment containing multiple coagulation baths spindles arranged side-by-side has now become the mainstream, increases in the widths of spinnerets and widths of coagulation baths mean that equipment with a larger width will be necessary and the required equipment cost will increase in some cases.

Next, for the spinning method proposed in Patent document 2, insight of the present inventors suggests that, as described above for Patent document 1, the accompanying flows around the coagulated fibers in the coagulation bath liquid cannot be relaxed sufficiently in some cases, which may cause disturbances in the flow of the coagulation bath liquid, generation of local vortices, and yarn breaks, possibly leading to a spinning failure in some cases. As a result, it becomes impossible in some cases to produce coagulated fibers with high quality and a certain required level of quality. In particular, as described in Examples of Patent document 2, the speed of winding after stretching is as low as 400 m/min (the take-up speed in the coagulation bath liquid is 10 m/min or less), and the number of discharge holes in the spinneret is also as small as 400, indicating that the size of the accompanying flows is small and does not pose a problem. However, the above problems can begin surfacing in some cases as the take-up speed and the number of holes are increased (up to a take-up speed of 25 m/min or more, several thousands of holes).

For the spinning method proposed in Patent document 2, furthermore, a plurality of direction changing guide parts are provided to divide the coagulated fibers and as a result, it is necessary to the thread each of the direction change guides, which may cause deterioration of operating performance in some cases. In addition, since a thin tube is provided under the coagulation bath to allow the flow of the coagulation bath liquid to move out of the coagulation bath, the equipment has a complicated structure because it requires multiple circulation lines and recovery lines for the flow of the coagulation bath liquid, leading to an increase in equipment cost in some cases.

Thus, for producing an acrylonitrile based fiber bundle, control of the flow of the coagulation bath liquid around coagulated fibers and control of the surface fluctuations of the coagulation bath liquid are extremely important factors. As described above, however, various problems remain and have hindered the production of acrylonitrile based fiber bundles. Therefore, solving these problems has an important industrial meaning.

Thus, the main object of the present invention is to provide a method for producing an acrylonitrile based fiber bundle by dry-jet wet spinning that serves to allow a high-grade, high-quality acrylonitrile based fiber bundle to be produced stably even if the traveling speed of the coagulated fibers is increased or the number of spinneret discharge holes is maximized in an attempt to enhance the production efficiency.

The present inventors have set the following hypotheses to explain why the spinnability of coagulated fibers cannot be sufficiently improved by the techniques proposed in Patent documents 1 and 2.

In the case of the technique proposed in Patent document 1, if the traveling speed of coagulated fibers is increased, accompanying flows are generated in the traveling region of the coagulated fibers. Then, to compensate for the accompanying flows, flows of the coagulation bath liquid moving from around the coagulated fibers toward the coagulated fibers are generated. The speed of the liquid flows is highest in the vicinity of the surface of the coagulation bath liquid. It is considered that along with this, a large drag force is applied to the coagulated fibers in the direction perpendicular to the traveling direction of the coagulated fibers, and fibers among the coagulated fibers come into a densely packed state.

In the case of the technique proposed in Patent document 2, if the direction in which the coagulated fibers are divided is the same as the flow direction Dc of the coagulation bath liquid moving toward the coagulated fibers, the collisions of liquid flows of the coagulation bath liquid cannot be avoided. Therefore, if the take-up speed of the coagulated fibers is increased, accompanying flows are generated in the traveling region of the coagulated fibers and accordingly, flows of the coagulation bath liquid moving from around coagulated fibers toward the coagulated fibers are generated. The speed of the flows is highest in the vicinity of the surface of the coagulation bath liquid. In particular, it is considered that the flows of the coagulation bath liquid moving toward coagulated fibers from around them collide from the direction perpendicular to the traveling direction of the coagulated fibers and this acts to cause the fibers among the coagulated fiber to come into a densely packed state.

The invention proposed herein was conceived as a result of intensive studies performed based on the above hypotheses with the aim of solving these problems.

Specifically, the present invention according to exemplary embodiments provides a production method for an acrylonitrile based fiber bundle characterized by first extruding a spinning dope solution through a plurality of discharge holes in a spinneret, then allowing the spinning dope solution to move downward into a coagulation bath liquid stored in a coagulation bath to form coagulated fibers, turning the coagulated fibers upward on a direction changing guide part located in the coagulation bath liquid below the spinneret, and pulling them out of the coagulation bath liquid, wherein the requirements 1) to 3) given below are met.

1) The axis direction of the direction changing guide part is perpendicular to both the traveling direction of the coagulated fibers moving from the surface of the coagulation bath liquid toward the direction changing guide part and the take-up direction of the coagulated fibers moving from the direction changing guide part and exiting out of the coagulation bath liquid.

2) The traveling region of the coagulated fibers ranging from the surface of the coagulating bath liquid to the direction changing guide part includes two or more fiber-existing regions containing coagulated fibers that exist continuously in the traveling direction of the coagulated fibers, and at least one fiber-free region free of coagulated fibers, which are continuously absent in the traveling direction of the coagulated fibers, wherein each fiber-free region is located between two fiber-existing regions.

3) For at least one of the fiber-free regions, the width thereof measured at the surface of the coagulation bath liquid in the axis direction of the direction changing guide part is at least four times the shortest distance between discharge holes in the spinneret.

According to embodiments of the present invention, a high-grade, high-quality acrylonitrile based fiber bundle can be produced stably by the dry-jet wet spinning technique performed under conditions characterized by high flow controllability for the coagulation bath liquid in the vicinity of the coagulated fibers and high production efficiency (higher speed (increased traveling speed of the fibers), multiple holes (increased number of discharge holes in the spinneret), and high densification (increased density of discharge hole arrangement in the spinneret)).

BRIEF DESCRIPTION OF THE DRAWINGS

FIG. 1: This is a schematic cross section view of the dry-jet wet spinning equipment used for the first embodiment of the present invention.

FIGS. 2 (*a*), (*b*), and (*c*): This gives schematic cross section views showing typical coagulation bath shapes in the dry-jet wet spinning equipment used for the embodiments of the present invention.

FIG. 3: This is a diagram showing typical flow shapes of the coagulation bath liquid in the conventional dry-jet wet spinning equipment.

FIG. 4: This is a top view of dry-jet wet spinning equipment used for the production method for an acrylonitrile based fiber bundle according to the present invention and illustrates features of the liquid flows at the surface of the coagulation bath liquid.

FIG. 5: This is a top view of dry-jet wet spinning equipment used for the production method for an acrylonitrile based fiber bundle according to the present invention and illustrates features of the liquid flows at the surface of the coagulation bath liquid.

FIG. 6: This is a top view of dry-jet wet spinning equipment used for the production method for an acrylonitrile based fiber bundle according to the present invention and illustrates features of the liquid flows at the surface of the coagulation bath liquid.

FIG. 7: This is a schematic cross section view of the conventional dry-jet wet spinning equipment.

FIG. 8: This is a diagram showing positions for measuring the flow speed of the coagulation bath liquid in dry-jet wet spinning equipment.

FIG. 9: This is a diagram showing positions for measuring the flow speed of the coagulation bath liquid in dry-jet wet spinning equipment.

FIG. 10: This is a diagram showing positions for measuring the flow speed of the coagulation bath liquid in dry-jet wet spinning equipment.

FIG. 11: This is a schematic cross section view of the dry-jet wet spinning equipment used for the second embodiment of the present invention.

FIG. 12: This is a schematic cross section view of the dry-jet wet spinning equipment used for the third embodiment of the present invention.

FIG. 13: This is a schematic cross section view of the dry-jet wet spinning equipment used for the fourth embodiment of the present invention.

FIG. 14: This is a schematic cross section view of the dry-jet wet spinning equipment used for the fifth embodiment of the present invention.

FIG. 15: This is a schematic cross section view of the dry-jet wet spinning equipment used for the sixth embodiment of the present invention.

FIG. 16: This is a schematic cross section view of the dry-jet wet spinning equipment used for the fifth embodiment of the present invention.

FIG. 17: This is a diagram showing positions for measuring the widths of fiber divisions in the coagulation bath in the dry-jet wet spinning equipment.

FIG. 18: This is a schematic cross section view of the dry-jet wet spinning equipment used in Comparative example 2.

FIG. 19: This is a schematic cross section view of the dry-jet wet spinning equipment used in Comparative example 5.

FIG. 20: This is a schematic cross section view of a fiber-free region and adjacent regions thereof, sectioned in parallel with the surface of the coagulation bath liquid.

DETAILED DESCRIPTION OF EMBODIMENTS OF THE INVENTION

The production method for an acrylonitrile based fiber bundle according to embodiments of the present invention is described in detail below with reference to drawings.

FIG. 1 is a schematic cross section view of the dry-jet wet spinning equipment used for the first embodiment of the present invention. For an embodiment of the present invention, it contains a spinneret 1, a coagulation bath 2, coagulated fibers 3, and direction changing guide part 4, and a coagulation solution 12 is stored in the coagulation bath 2, as illustrated in FIG. 1. The spinning dope solution is extruded first into the air from the plurality of discharge holes in the spinneret 1, and then the spinning dope solution reaches the surface 9 of the coagulation bath liquid and comes in contact with the coagulation bath liquid to form coagulated fibers 3, which run into the coagulation bath liquid, turn upward on the direction changing guide part 4, travel through the coagulation bath liquid toward the surface 9 of the coagulation bath liquid. After running along this traveling path, it is pulled out into the air. Here, the traveling direction Da represents the direction in which the coagulated fibers 3 travel from the surface 9 of the coagulation bath liquid toward the direction changing guide part 4, and the take-up direction Db represents the direction in which the coagulated fibers 3 travel from the direction changing guide part 4 toward the surface 9 of the coagulation bath liquid. Here, the direction changing guide part 4 is disposed in the direction perpendicular to both the traveling direction Da of the coagulated fibers 3 and the take-up direction Db of the coagulated fibers 3. The traveling region of the coagulated fibers 3 ranging from the surface 9 of the coagulating bath liquid to the direction changing guide part 4 includes two or more fiber-existing regions 24 containing coagulated fibers 3 that exist continuously in the traveling direction Da of the coagulated fibers 3 and at least one fiber-free region 23 free of coagulated fibers 3, which are continuously absent in the traveling direction Da of the coagulated fibers. Each fiber-free region 23 is located between two fiber-existing regions 24. The width of a fiber-free region 23 measured at the surface 9 of the coagulation bath liquid in the axis direction of the direction changing guide part 4 is equal to or larger than a certain value defined later.

Here, the traveling region of the coagulated fibers 3 means the region ranging between the outermost ones of the set of coagulated fibers 3 traveling from the surface 9 of the coagulation bath liquid to the direction changing guide part 4. On the other hand, the fiber-free region refers to the region 23 in FIG. 20, which shows a cross section of the coagulation bath liquid sectioned in the direction parallel to the liquid surface. It is defined by a set of positions where virtual circles 26 having a diameter that is equal to the shortest distance between discharge holes in the spinneret can exist without internally overlapping the cross section of any of the single fibers 25 among the coagulated fibers. In this regard, the position 26' in FIG. 20 shows a position where a virtual circle having a diameter that is equal to the shortest distance between discharge holes in the spinneret 1 internally overlaps the cross sections of single fibers 25 among the coagulated fibers. The present invention according to exemplary embodiments is characterized in that in any cross section of the traveling region of the coagulated fibers 3 sectioned in the traveling direction Da of the coagulated fibers 3 running from the surface 9 of the coagulation bath liquid to the direction change guide part 4, the fiber-free region 23 exists continuously in the traveling direction Da of the coagulated fibers 3 (that is, any of the coagulated fibers 3 is continuously absent in the traveling direction Da of the coagulated fibers 3). In addition, the traveling region of the coagulated fibers 3 excluding the fiber-free regions 23 is defined as the fiber-existing regions 24.

Here, in its best form, the coagulation bath 2 has a coagulation bath bottom face 6 that gradually becomes shallow along the take-up direction Db in which the coagulated fibers 3 travel after being turned upward by the direction changing guide part 4. This serves to ensure a decrease in the capacity of the coagulation bath 2 and a decrease in the volume of the coagulation bath liquid. As compared with this, as illustrated in FIG. 2, the coagulation bath bottom face 6 may have a bottom shape that is parallel to the surface 9 of the coagulation bath liquid (FIG. 2(*a*)) or may have a bottom shape that gradually becomes deeper along the traveling direction Da in which the coagulated fibers 3 travel after being turned upward by the direction changing guide part 4 (FIG. 2(*b*)). Instead, the coagulation bath bottom face 6 may have a bottom shape that is partly stepwise (FIG. 2(*c*)). In this case, if the coagulation bath bottom face 6 is parallel to the surface 9 of the coagulation bath liquid in the region between the position where the coagulated fibers 3 are pulled out into the air and the coagulation bath rear face 8, it can allow for a large space to receive liquid flows attributed to accompanying flows of the coagulated fibers 3 and this in turn serves to decrease the flow speed of these liquid flows and minimize their collisions against the coagulation bath rear face 8, thereby suppressing the fluctuations of the surface 9 of the coagulation bath liquid. The bottom shape of the coagulation bath 2 is not particularly limited because it has little influence on the main flows of the coagulation bath liquid as described later.

Described below is the principle of stable production of a high-grade, high-quality acrylonitrile based fiber bundle that serves to realize a high productivity, which represents the most important point of the present invention, even if:

A. the traveling speed of the coagulated fiber 3 is increased,

B. the number of discharge holes in the spinneret 1 is maximized, or

C. densification of discharge hole arrangement is implemented.

For the present invention, the flows of the coagulation bath liquid in the coagulation bath are referred to simply as liquid flows, and among the liquid flows, those caused by the traveling of a coagulated fiber 3 and flowing in parallel with the coagulated fiber 3 in the traveling direction Da or the take-up direction Db of the coagulated fiber 3 are defined as accompanying flows.

It should be noted first that accompanying flows in the coagulation bath increase if any of the above schemes (A. to C.) is carried out in an attempt to enhance the productivity of the conventional acrylonitrile based fiber bundle production method, which is outside the scope of the present invention. The mechanism thereof is described below with reference to FIG. 3. As the coagulated fibers 3 travel, accompanying flows in the traveling direction Da occur in the traveling region ranging from the surface 9 of the coagulation bath liquid to the direction changing guide part 4, whereas accompanying flows in the take-up direction Db occur in the traveling region ranging from the direction changing guide part 4 to the surface 9 of the coagulation bath liquid. As these accompanying flows are generated, liquid flows toward the coagulated fibers 3 will occur in the region below the spinneret 1, and the speed of the liquid flows will be at a maximum in the vicinity of the surface 9 of the coagulation bath liquid. In particular, since the coagulated fibers 3 have to be pulled out of the surface 9 of the coagulation bath liquid on the downstream side of the direction changing guide part 9, very fast liquid flows attributed to the accompanying flows in the take-up direction Db of the coagulated fiber 3 will move into the region below the spinneret 1. As a result, these liquid flows collide against the coagulated fibers 3 in the region between the surface 9 of the coagulation bath liquid and the direction changing guide part 4, and a large collision energy occurs in the vicinity of the surface 9 of the coagulation bath liquid due to the fast liquid flows. Accordingly, in the coagulated fibers 3, circumferential ones are pulled toward the central portion and the fibers are densely packed to cause contact between fibers and local vortices, leading to a very large deterioration in spinnability, grade, and quality.

As compared with this, the production method for an acrylonitrile based fiber bundle according to an embodiment of the present invention is characterized in that the speed of the liquid flows colliding against the coagulated fibers 3 can be decreased even if the schemes (A. to C.) are implemented in order to achieve a high productivity. There are two techniques to meet this object: one is intended to directly reduce liquid flows by reducing the accompanying flows that act as driving force to move liquid flows toward the coagulated fibers 3 and the other is intended to reduce the proportion of liquid flows colliding against the coagulated fibers 3 by dividing the liquid flows moving toward the coagulated fibers 3 to form a fiber-free region 23 where the resistance to liquid flows is small. These two techniques can be applied simultaneously to the production method according to embodiments of the present invention.

The technique for decreasing the speed of the liquid flows colliding against the coagulated fibers 3 is described below. For the production method according to an embodiment of the present invention, as illustrated in FIG. 1, the traveling region of the coagulated fibers 3 ranging from the surface 9 of the coagulating bath liquid to the direction changing guide part 4 includes two or more fiber-existing regions 24 containing coagulated fibers 3 that exist continuously in the traveling direction Da of the coagulated fibers 3 and at least one fiber-free region 23 free of coagulated fibers 3, which are continuously absent in the traveling direction Da of the coagulated fibers 3. The fiber-free region 23 is located between two fiber-existing regions 24. Here, the width of the fiber-free region 23 measured at the surface 9 of the coagulation bath liquid in the axis direction of the direction changing guide part 4 should be at least four times, preferably at least eight times, the shortest distance between discharge holes in the spinneret 1.

As an advantage of this, the coagulated fibers 3 traveling from the surface 9 of the coagulation bath liquid to the direction changing guide part 4 are divided into a plurality of fiber groups (two groups in FIG. 1) and accordingly, accompanying flows are generated in varied directions as compared with the conventional method, in which only one fiber group is formed, leading to a decrease in the overall scale of the accompanying flows. In connection with the width of the fiber-free region 23 measured at the surface 9 of the coagulation bath liquid in the axis direction of the direction changing guide part 4, if there is a plurality of fiber-free regions, the advantageous effect of the present invention will be realized as long as at least one of them meets the aforementioned relation between its width and the shortest distance between discharge holes in the spinneret 1, but it is preferable for the aforementioned relation between the width and the shortest distance between discharge holes in the spinneret 1 to be met in all of the fiber-free regions because the advantageous effect of the present invention will be realized more prominently.

In addition, as another great advantage, if two types of regions, that is, the fiber-existing region 24, which contains coagulated fibers 3, and the fiber-free region 23, which does not contain coagulated fibers 3, exist at the surface 9 of the coagulation bath liquid as illustrated in FIG. 4, it acts to cause a difference in liquid flow passage resistance between the fiber-existing region 24 and the fiber-free region 23. As a result, liquid flows will run more smoothly in the fiber-free region 23 than in the fiber-existing region 24 and this works to divide the liquid flows, serving to reduce the speed of the liquid flows moving toward the coagulated fiber 3.

To realize the above effect, therefore, it is important to form a fiber-free region 23 at the position where accompanying flows start to occur and at the position where the speed of the liquid flows colliding against the coagulated fibers 3 reaches a maximum, suggesting that when looking at the surface 9 of the coagulation bath liquid, a fiber-free region 23 exists between fiber-existing regions 24. At this time, liquid flows attributed to accompanying flows generated in the take-up direction Db move into the region below the spinneret 1 from the direction perpendicular to the axis direction of the direction changing guide part 4 and accordingly, it should have a width, i.e. the size in the axis direction of the direction changing guide part 4, equal to or larger than a certain value (at least four times the shortest distance between discharge holes in the spinneret 1).

As compared with this, in the case of the setup illustrated in FIG. 7, which is outside the scope of the present invention, a plurality of direction changing guide parts 4 are provided (arranged in the take-up direction Db in FIG. 7) and the coagulated fibers 3 are divided between the direction changing guide parts 4 to form fiber-free regions 23. As described above, however, liquid flows move into the region below the spinneret 1 from the direction perpendicular to the axis direction of the direction changing guide parts 4 (right to left in FIG. 7), but there is no fiber-free region 23 in the side face against which the liquid flows collide, leading to a failure in decreasing the speed of the liquid flows. In particular, in the case of a coagulation bath in which accompanying flows generated in the take-up direction Db prevail, the effect of decreasing the speed of liquid flows will be largely diminished. In addition, it will require a very large workload for putting coagulated fibers 3 around a plurality of direction changing guide parts 4, leading to a decrease in operating performance.

Furthermore, the width of the fiber-free region 23 free of coagulated fibers 3 measured in the direction of the direction changing guide part 4 is preferably at least four times the shortest distance between discharge holes in the spinneret 1 and such a width is preferably maintained continuously from the surface 9 of the coagulation bath liquid to the direction changing guide part 4. As a result, this works more effectively to vary the generation directions of accompanying flows, leading to a more remarkable effect in decreasing liquid flows colliding against the coagulated fibers 3. Here, in the case where there exist a plurality of fiber-free regions 23 and fiber-existing regions 24, their widths measured in the axis direction of the direction changing guide parts 4 may be constant or variable.

Furthermore, as compared with the maximum width S of the coagulated fibers 3 at the surface 9 of the coagulation bath liquid measured in the axis direction of the direction changing guide part 4 (i.e., the width of the fiber-existing regions 23 located outermost in the direction of the direction changing guide part 4), it is preferable for the maximum width of the coagulated fibers 3 measured on the direction changing guide part 4 in the axis direction of the direction changing guide part 4 to be 1.2 S or less. If it is in this range, accompanying flows are generated in varied directions and at the same time, the width of the discharge holes in the spinneret 1 can be reduced to serve to realize decreased equipment costs.

As described above, furthermore, as the use of equipment containing a plurality of coagulation baths arranged side-by-side has now become the mainstream, a decrease in the width H of each coagulation bath leads to a reduction in the equipment cost and the resulting decrease in the required volume of the coagulation bath liquid leads to a reduction in the collection load. To decrease the width H of the coagulation bath, it is effective to shorten the maximum width S of the coagulated fibers 3 at the surface 9 of the coagulation bath liquid and to make the S/H ratio closer to 1, preferably in the ratio of $0.5 \leq S/H \leq 0.95$. As the S/H ratio becomes closer to 1, it leads to a higher flow speed of the liquid flows attributed to accompanying flows, but the use of the production method according to embodiments of the present invention will have more noticeable effect to realize a decrease in the liquid flow speed.

In addition, as the production method according to embodiments of the present invention is designed to reduce the liquid flows colliding against the coagulated fibers 3, it is preferable for the average flow speed of the coagulation bath liquid moving toward the coagulated fibers to be 14 mm/second or less at any position that is 40 mm away in the depth direction from the surface of the coagulation bath liquid and 20 mm away from a point that is included in the traveling region of the coagulated fibers and located closest to the exit where the coagulated fibers are pulled out of the coagulation bath, which is measured in the take-up direction Db of the coagulated fibers and in parallel with the surface of the coagulation bath liquid, as illustrated in FIG. 8, FIG. 9, and FIG. 10.

Next, another embodiment of the present invention is described in detail below. There may exit only one fiber-free region 23 free of the coagulated fibers 3 as shown in FIG. 1, but may exit a plurality of two or more of such regions as shown in FIG. 11 (the second embodiment of the present invention). An increase in the number of fiber-free regions free of the coagulated fibers 3 serves to decrease the speed of the liquid flows colliding against the coagulated fibers 3. If the number of the fiber-free regions 23 is increased, on the other hand, the width of the coagulation bath 2 has to be increased to lead to an increased equipment cost and a steeper angle of the coagulated fiber 3 entering the surface 9 of the coagulation bath liquid, possibly causing a deterioration in spinnability. Thus, there is a limit to the number of the fiber-free regions 23. Accordingly, it is preferable for the number of fiber-free regions to be four or less.

As a method to form a fiber-free region 23 free of coagulated fibers 3 in carrying out the production method according to the present invention, a fiber-dividing guide part 13 may be provided between the surface 9 of the coagulation bath liquid and the direction changing guide part 4 as illustrated in FIG. 12 (the third embodiment of the present invention). There are no specific limitations on the method, and instead of the above one, the direction changing guide part 4 may have a protrusion or a groove to divide the coagulated fibers 3 or may be combined with a fiber-dividing guide part.

For the production method according to the present invention, furthermore, as illustrated in FIG. 13 (the fourth embodiment of the present invention), the width of the fiber-free region 23 ranging from the surface 9 of the coagulation bath liquid to the direction changing guide part 4 measured in the direction of the direction changing guide part 4 may vary. It may decrease gradually or may increase gradually. Instead of this, the width of the fiber-free region 23 may be constant as shown in FIG. 14 (the fifth embodiment of the present invention) and FIG. 15 (the sixth embodiment of the present invention). As shown in FIG. 16 (the seventh embodiment of the present invention), furthermore, a plurality of fiber-existing regions 24 may be formed by coagulated fibers extruded from separate spinnerets corresponding to each of them.

Described next are features and shapes of members that are common to all dry-jet wet spinning apparatuses useful for the production method according to embodiments of the present invention.

For the production method according to embodiments of the present invention, it is best to use a spinneret 1 having a rectangular cross section, but its cross-sectional shape is not particularly limited and may be circular, elliptic, or polygonal. In addition, it is best for the discharge holes to be arranged in a rectangular region in the spinneret 1, although there are no particular limitations. Furthermore, the number of discharge holes is preferably in the range of 1,000 to 60,000, more preferably in the range of 6,000 to 24,000. The advantageous effect of the present invention can be realized to the maximum when it is in this range. In regard to the density of the discharge holes arranged in the discharge face of the spinneret 1, it is preferable for the number of discharge holes per $mm^2$ in the spinneret 1 is preferably 0.06 holes/$mm^2$ or more, more preferably 0.25 holes/$mm^2$ or more.

In regard to the number of spinnerets 1 used for the production method according to the present invention, it is preferable to adopt only one spinneret to ensure reduced equipment cost, but coagulated fibers 3 may be extruded from two or more spinnerets 1 arranged side-by-side in the width direction of the coagulation bath.

If the take-up speed of the coagulated fibers 3 is increased, furthermore, accompanying flows in the coagulation bath will increase, and the speed of the liquid flows moving toward the coagulated fibers 3 that are traveling from the spinneret 1 to the direction changing guide part 4 will also increase near the surface 9 of the coagulation bath liquid. For the production method according to the present invention, the take-up speed of the coagulated fibers pulled out of the coagulation bath is preferably controlled at 50 m/min or less. From the viewpoint of preventing a decrease in the production efficiency, on the other hand, the speed of the coagulated fibers 3 pulled out of the coagulation bath is preferably controlled at 25 m/min or more.

The coagulation bath 2 used for the production method according to the present invention preferably has a structural feature that a supply inlet 10 is provided on the coagulation bath bottom face 6, wherein the supply inlet 10 is connected to a liquid circulation pump (not shown in the figures) to supply a coagulation solution from the liquid circulation pump. In this case, it is preferable for the coagulation solution in the coagulation bath 2 to be flowing out over the top edges of the coagulation bath front face 7 and the coagulation bath rear face 8.

It is preferable for the direction changing guide part 4 used for the production method according to the present invention to have a single step guiding structure to turn the coagulated fibers 3 to an upward direction, but there are no particular limitations on the structure, and a two or more step guiding structure may be adopted to turn them through a large angle to an upward direction.

Furthermore, it is preferable for the spinning dope solution used for the production method according to the present invention to be one prepared by dissolving an acrylonitrile based polymer in a solvent, although there are no particular limitations thereon. Useful monomers to be copolymerized with acrylonitrile (AN) include, for example, acrylic acid, methacrylic acid, itaconic acid, alkali metal salts thereof, ammonium salts, lower alkyl esters, acrylamide, derivatives thereof, allyl sulfonic acid, methallylsulfonic acid, salts thereof, and alkyl esters thereof.

In addition, useful solvents for the spinning dope solution used for the production method according to embodiments of the present invention include, for example, aqueous zinc chloride solution, dimethyl acetamide, dimethyl sulfoxide (hereinafter abbreviated as DMSO), and dimethyl formamide.

Then, it is preferably spun by the production method according to the present invention, followed by pulling out the coagulated fibers 3 into the air and drawing them in water. Here, after the spinning step, the resulting coagulated fibers 3 are preferably drawn in water and then rinsed, or rinsed first and then drawn in water, to remove the remaining solvent. After being drawn in water, it is commonly supplied with an oil agent and then dried and densified by a hot roller etc. In addition, it is subjected to secondary drawing such as steam drawing as required. For the present invention, the plurality of acrylonitrile based fiber bundles prepared by carrying out these steps is combined by a group of free roller guides designed for bundling before winding-up or storing in a can and subsequently, it is wound up into a package by a winding machine or stored in a can. According to another embodiment, acrylonitrile based fiber bundles are wound up once and then a plurality thereof is unwound or pulled out of the can, followed by combining them using a group of free roller guides designed for bundling. It is preferable for an acrylonitrile based fiber bundle to contain 1,000 or more, more preferably 2,000 or more, single fibers. Although there is no specific upper limit to the number of single fibers, the common range is 100,000 or less.

Described next is the method for producing a carbon fiber bundle from an acrylonitrile based fiber bundle prepared by the production method according to an embodiment of the present invention.

The acrylonitrile based fiber bundle prepared by the production method for a acrylonitrile based fiber bundle described above is subjected to oxidization treatment in an oxidizing atmosphere such as air at 200° C. to 300° C. To produce a good oxidized fiber bundle, it is preferable to raise the treatment temperature stepwise from a low temperature to a high temperature. To provide a carbon fiber bundle showing highly developed performance, furthermore, it is preferable to stretch the fiber bundle to a high stretching ratio unless fuzz generation occurs. Then, the resulting oxidized fiber bundle is heated to a temperature of 1,000° C. or more in an inert atmosphere such as nitrogen to produce a carbon fiber bundle. Subsequently, it is anodized in an aqueous electrolyte solution to form functional groups on the carbon fiber surface in order to increase adhesiveness to resin. In addition, it is preferable to subsequently supply a sizing agent such as epoxy resin to produce a carbon fiber bundle having high abrasion resistance.

EXAMPLES

The present invention will now be illustrated in detail with reference to Examples although the invention is not limited thereto.

(1) Average flow speed of coagulation bath liquid near the liquid surface

While keeping a microbubble generator (BT-50-5, manufactured by Nishiyama Pump Service Co., Ltd.) operating to generate microbubbles in a coagulation bath, the flow speed of the coagulation bath liquid was measured (sampling frequency 25 Hz, measuring period 30 seconds) using an ultrasonic Doppler current meter (10-MHZ ADV, manufactured by SonTek). The flow speed of the coagulation bath liquid was measured at three points located on the rear side of (nearer to coagulation bath front face 8 than) the center line of the spinneret 1 as shown in FIG. 8, FIG. 9, and FIG. 10. With respect to their vertical positions, the measuring points were positioned 40 mm away in the depth direction from the surface 9 of the coagulation bath liquid, whereas with respect to their positions in the width direction of the coagulation bath, two of them are 160 mm away from each other and located on either side of the center line of the spinneret 1 and the other one is located on the center line. Thus, measurements were taken at the three points defined above. For each measuring position, the time average (absolute value) of the measurements ((sampling frequency 25 Hz/second)×continuous measuring period 30 seconds=750 measurements) was calculated.

(2) Number of Generated Vortices

A water tank having transparent acrylic walls was installed at the side of the coagulation bath front face 8, and the surface of the coagulation bath liquid was pictured using a video camera. The surface of the coagulation bath liquid was pictured for one minute, and 60 images were taken at intervals of one second. The number of local vortices included in each image was counted and the average number of vortices was calculated.

(3) Grade of Acrylonitrile Based Fiber Bundle

The acrylonitrile based fiber bundle was observed immediately before it was wound up and the number of fuzz hairs on 1,000 m of the acrylonitrile based fiber bundle was counted to make a quality evaluation. The criterion for the evaluation was as given below.

A: (number of fuzz hairs on 1,000 m of a fiber bundle)≤1

B: 1<(number of fuzz hairs on 1,000 m of a fiber bundle)≤5

C: 5<(number of fuzz hairs on 1,000 m of a fiber bundle)<60

D: (number of fuzz hairs on 1,000 m of a fiber bundle) ≥60.

(4) Fiber Division

Fibers were divided in the axis direction of the direction changing guide part or in the direction from rear face to the front face of the coagulation bath (hereinafter referred to occasionally as front-rear direction). In addition, the division width associated with the fiber division was measured at the three positions shown in FIG. 17: division at the height of the surface of the coagulation bath liquid, division at the center height between the surface of the coagulation bath liquid and the direction changing guide part, and division at the height of the direction changing guide part, which are referred to as upper level division 20, center level division 21, and lower level division 22, respectively. The division width decreases monotonously or increases monotonously between these positions. Here, in the case where the direction of fiber division coincides with the axis direction of the direction changing guide part, the division width is the same as the width of the fiber-free region.

Example 1

A dry-jet wet spinning apparatus as illustrated in FIG. 13 was set up in which fibers were divided into two groups in the axis direction of the direction changing guide part in such a manner that the division width was 10 mm for the upper level division, 5 mm for the center level division, and 5 mm at the lower level division. The shortest distance between discharge holes in the spinneret was 2 mm. The spinning dope solution was first extruded from the spinneret into the air, allowed to run downward into a coagulation bath liquid of an aqueous DMSO solution, turned upward through an angle of 65° by the direction changing guide part 4, pulled out of the coagulation bath liquid at 34 m/min, and then introduced into a washing process in water. Subsequently, an oil agent containing amino silicone as primary component was applied while drawing the fibers in water, and they were subjected to drying and post-stretching steps to provide an acrylonitrile based fiber bundle. The coagulation bath liquid near the surface of the coagulation bath liquid had an average flow speed V of 8 mm/second and vortices were generated at a rate of 0.3 per second, resulting in an acrylonitrile based fiber bundle of a high grade.

Example 2

Described below is Example 2 where the division width of fibers was larger at the center and lower levels than in Example 1. Except that the division width of fibers at the center level was 10 mm and that the division width at the lower level was 10 mm as illustrated in FIG. 14, the same equipment and operating conditions as in Example 1 were adopted to produce an acrylonitrile based fiber bundle. The coagulation bath liquid near the surface of the coagulation bath liquid had an average flow speed V of 4 mm/second and vortices were generated at rate of 0.1 per second, resulting in an acrylonitrile based fiber bundle of a higher grade than in Example 1.

Example 3

Described below is Example 3 where the number of fiber divisions was larger than in Example 2. Except that fibers were divided into four groups in the axis direction of the direction changing guide part, that the division width of fibers at the upper level was 10 mm, that the division width at the center level was 10 mm, and that the division width at the lower level was 10 mm as illustrated in FIG. 15, the same equipment and operating conditions as in Example 2 were adopted to produce an acrylonitrile based fiber bundle. The coagulation bath liquid near the surface of the coagulation bath liquid had an average flow speed V of 3 mm/second and vortices were generated at a rate of 0.1 per second, resulting in an acrylonitrile based fiber bundle of a higher grade than in Example 1, as in the case of Example 2.

Example 4

Described below is Example 4 where two of the spinneret adopted in Example 1 were used. Except that two spinnerets were used as illustrated in FIG. 16, the same equipment and operating conditions as in Example 1 were adopted to produce an acrylonitrile based fiber bundle. The coagulation bath liquid near the surface of the coagulation bath liquid had an average flow speed V of 8 mm/second and vortices were generated at a rate of 0.3 per second, resulting in an acrylonitrile based fiber bundle of a high grade.

Comparative Example 1

Described below is Comparative example 1 where the fibers were not divided. Except that the fibers were not divided, the same equipment and operating conditions as in Example 1 were adopted to produce an acrylonitrile based fiber bundle. The coagulation bath liquid near the surface of the coagulation bath liquid had an average flow speed V of 30 mm/second and vortices were generated at a rate of 1.8 per second, resulting in an acrylonitrile based fiber bundle of a low grade.

Comparative Example 2

Described below is Comparative example 2 where the fibers were not divided at the upper level. Except that the fibers were not divided at the upper level as illustrated in FIG. 18, the same equipment and operating conditions as in Example 1 were adopted to produce an acrylonitrile based fiber bundle. The coagulation bath liquid near the surface of the coagulation bath liquid had an average flow speed V of 25 mm/second and vortices were generated at a rate of 1.6 per second, resulting in an acrylonitrile based fiber bundle of a low grade.

Comparative Example 3

Described below is Comparative example 3 where the fibers were divided in the front-rear direction. Except that the fibers were not divided in the axis direction of the direction changing guide part, but divided into two groups in the front-rear direction as illustrated in FIG. 7, the same equipment and operating conditions as in Example 1 were adopted to produce an acrylonitrile based fiber bundle. The coagulation bath liquid near the surface of the coagulation bath liquid had an average flow speed V of 29 mm/second and vortices were generated at a rate of 1.8 per second, resulting in an acrylonitrile based fiber bundle of a low grade.

Comparative Example 4

Described below is Comparative example 4 where the division width of fibers was less than the required width specified for the present invention. Except that the division width of fibers at the upper level was 5 mm, that the division width at the center level was 5 mm, and that the division width at the lower level was 5 mm, the same equipment and operating conditions as in Example 1 were adopted to produce an acrylonitrile based fiber bundle. The coagulation bath liquid near the surface of the coagulation bath liquid had an average flow speed V of 22 mm/second and vortices were generated at a rate of 1.2 per second, resulting in an acrylonitrile based fiber bundle of a low grade.

Comparative Example 5

Described below is Comparative example 5 where the fibers were not divided at the center level to leave separated fiber-free regions. Except that the fibers were not divided at the center level to leave separated fiber-free regions as illustrated in FIG. 19, the same equipment and operating conditions as in Example 2 were adopted to produce an acrylonitrile based fiber bundle. The coagulation bath liquid near the surface of the coagulation bath liquid had an average flow speed V of 20 mm/second and vortices were generated at a rate of 1.0 per second, resulting in an acrylonitrile based fiber bundle of a low grade.

TABLE 1

| | | Example 1 | Example 2 | Example 3 | Example 4 | Comparative example 1 | Comparative example 2 | Comparative example 3 | Comparative example 4 | Comparative example 5 |
|---|---|---|---|---|---|---|---|---|---|---|
| Shortest distance between discharge holes | [mm] | 2 | 2 | 2 | 2 | 2 | 2 | 2 | 2 | 2 |
| Number of spinnerets | [number] | 1 | 1 | 1 | 2 | 1 | 1 | 1 | 1 | 1 |
| Direction of fiber division | A, B* | A | A | A | A | — | A | B | A | A |
| Number of divisions | [number] | 2 | 2 | 4 | 2 | 1 | 2 | 2 | 2 | 2 |
| Division width upper level | [mm] | 10 | 10 | 10 | 10 | — | — | 10 | 5 | 10 |
| center level | [mm] | 5 | 10 | 10 | 5 | — | 10 | 15 | 5 | — |
| lower level | [mm] | 5 | 10 | 10 | 5 | — | 10 | 20 | 5 | 10 |
| Average flow speed of coagulation bath liquid near liquid surface | [mm/sec] | 8 | 4 | 3 | 8 | 30 | 25 | 29 | 22 | 20 |
| Number of vortices generated | [number/sec] | 0.3 | 0.1 | 0.1 | 0.3 | 1.8 | 1.6 | 1.8 | 1.2 | 1.0 |

TABLE 1-continued

| | | Example 1 | Example 2 | Example 3 | Example 4 | Comparative example 1 | Comparative example 2 | Comparative example 3 | Comparative example 4 | Comparative example 5 |
|---|---|---|---|---|---|---|---|---|---|---|
| Grade of acrylonitrile fiber bundle | [–] | B | A | A | B | D | D | D | C | C |

*A: axis direction of direction changing guide part B: front-rear direction

EXPLANATION OF NUMERALS

1. spinneret
2. coagulation bath
3. coagulated fibers
4. direction changing guide part
5. take-up guide part
6. coagulation bath bottom face
7. coagulation bath front face
8. coagulation bath rear face
9. surface of coagulation bath liquid
10. supply inlet
11. circulation pump
12. coagulation bath liquid
13. fiber-dividing guide part
20. division at upper level
21. division at center level
22. division at lower level
23. fiber-free region
24. fiber-existing region
25. single fiber among coagulated fibers
26. virtual circle having a diameter equal to the shortest distance between discharge holes in the spinneret
26'. virtual circle having a diameter equal to the shortest distance between discharge holes in the spinneret and internally overlapping the cross sections of a single fiber among the coagulated fibers
S. maximum width of coagulated fibers at surface of coagulation bath liquid
T. maximum width of coagulated fibers at direction changing guide part
H. width of coagulation bath
M. measuring point for flow speed
W. width of fiber-free region
Da. traveling direction
Db. take-up direction
Dc. liquid flow direction

The invention claimed is:

1. A production method for an acrylonitrile based fiber bundle comprising the steps of first extruding a spinning dope solution through a plurality of discharge holes in a spinneret, then allowing the spinning dope solution to run downward into a coagulation bath liquid stored in a coagulation bath to form coagulated fibers, turning the coagulated fibers upward on a direction changing guide part located in the coagulation bath liquid below the spinneret, and pulling them out of the coagulation bath liquid, wherein the requirements 1) to 3) given below are met:

1) the axis direction of the direction changing guide part is perpendicular to both the traveling direction of the coagulated fibers moving from the surface of the coagulation bath liquid toward the direction changing guide part and the take-up direction of the coagulated fibers moving from the direction changing guide part and exiting out of the coagulation bath liquid,
2) the traveling region of the coagulated fibers ranging from the surface of the coagulating bath liquid to the direction changing guide part includes two or more fiber-existing regions containing coagulated fibers that exist continuously in the traveling direction of the coagulated fibers, and at least one fiber-free region free of coagulated fibers, which are continuously absent in the traveling direction of the coagulated fibers, wherein each fiber-free region is located between two fiber-existing regions, and
3) for at least one of the fiber-free regions, the width thereof measured at the surface of the coagulation bath liquid in the axis direction of the direction changing guide part is at least four times the shortest distance between discharge holes in the spinneret.

2. A production method for an acrylonitrile based fiber bundle as set forth in claim 1, wherein in all fiber-free regions, the width measured at the surface of the coagulation bath liquid in the axis direction of the direction changing guide part is at least four times the shortest distance between discharge holes in the spinneret.

3. A production method for an acrylonitrile based fiber bundle as set forth in claim 1, wherein the number of discharge holes is 0.06 or more per square millimeter of the spinneret.

4. A production method for an acrylonitrile based fiber bundle as set forth in claim 1, wherein the coagulation bath liquid has an average flow speed and the average flow speed of the coagulation bath liquid moving toward the coagulated fibers is 14 mm/second or less at any position that is 40 mm away in a depth direction from the surface of the coagulation bath liquid and 20 mm away from a point that is included in the traveling region of the coagulated fibers and located closest to the exit where the coagulated fibers are pulled out of the coagulation bath, as measured in the take-up direction of the coagulated fibers and in parallel with the surface of the coagulation bath liquid.

5. A production method for an acrylonitrile based fiber bundle as set forth in claim 1, wherein only one spinneret is used to extrude the spinning dope solution.

6. A production method for an acrylonitrile based fiber bundle as set forth in claim 1, wherein the spinneret has 1,000 to 60,000 discharge holes.

7. A production method for an acrylonitrile based fiber bundle as set forth in claim 1, wherein the take-up speed, which is the speed of the coagulated fibers being pulled out of the coagulation bath liquid, is 25 to 50 m/min.

8. A production method for an acrylonitrile based fiber bundle as set forth in claim 1, wherein the width of the fiber-free regions increases monotonously from the spinneret toward the surface of the coagulation bath liquid.

9. A production method for a carbon fiber bundle comprising a step of preparing an acrylonitrile based fiber bundle by the production method as set forth in claim 1, oxidizing the acrylonitrile based fiber bundle in an oxidizing atmosphere at 200° C. to 300° C., and subsequently heating it in an inert atmosphere at 1,000° C. or more.

* * * * *